US007533469B2

(12) United States Patent
Skrivan et al.

(10) Patent No.: US 7,533,469 B2
(45) **Date of Patent: *May 19, 2009**

(54) COMPETITION/LEASHLESS ICE AXE WITH ADJUSTABLE GRIP

(75) Inventors: Joseph Skrivan, Draper, UT (US); William R. Belcourt, Salt Lake City, UT (US); David S. Sanders, Salt Lake City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/498,533

(22) Filed: Aug. 2, 2006

(65) Prior Publication Data

US 2007/0028462 A1 Feb. 8, 2007

Related U.S. Application Data

(63) Continuation-in-part of application No. 11/231,534, filed on Sep. 20, 2005, now abandoned, which is a continuation of application No. 10/635,102, filed on Aug. 6, 2003, now Pat. No. 6,944,955.

(60) Provisional application No. 60/401,987, filed on Aug. 7, 2002.

(51) Int. Cl.
*B26B 23/00* (2006.01)

(52) U.S. Cl. ..... 30/308.1; 7/145; D8/76

(58) Field of Classification Search ..... 30/308.1, 30/340; 7/145, 169; D8/76
See application file for complete search history.

(56) References Cited

U.S. PATENT DOCUMENTS

| | | | |
|---|---|---|---|
| 29,192 | A | 7/1860 | Porter |
| 263,104 | A | 8/1882 | Bickel |
| 511,768 | A | 1/1894 | French |
| 802,937 | A | 10/1905 | Mccune et al. |
| 982,564 | A | 1/1911 | Baker |
| 1,054,823 | A | 3/1913 | Burks |
| 1,164,092 | A | 12/1915 | Higgs |
| 1,177,472 | A | 3/1916 | Bartlett |

(Continued)

FOREIGN PATENT DOCUMENTS

| | | |
|---|---|---|
| DE | 3442933 | 6/1986 |

(Continued)

OTHER PUBLICATIONS

The Top Machine Art. 38 2001 Grivel Catalog.
Quark Ergo, 2002 Charlet Moser Catalog of Petzl.

*Primary Examiner*—Hwei-Siu C Payer
(74) *Attorney, Agent, or Firm*—Trent H. Baker; Baker & Associates PLLC

(57) ABSTRACT

An ice axe device has an adjustable grip. The ice axe includes an elongated shaft with opposite proximal and distal ends. A pick is disposed at the distal end of the elongated shaft, and a grip is disposed at the proximal end of the elongated shaft. A pommel is adjustably securable to the grip,. A spike can be disposed on the proximal end of the grip. At least one spacer can be selectively disposable on the grip to selectively shorten and lengthen the length of the grip.

16 Claims, 6 Drawing Sheets

U.S. PATENT DOCUMENTS

| | | | | | |
|---|---|---|---|---|---|
| 1,259,161 | A | | 3/1918 | Suer | |
| 1,309,180 | A | | 7/1919 | Carr | |
| 1,330,213 | A | | 2/1920 | Munzer | |
| 1,388,872 | A | | 8/1921 | McElhaney | |
| D124,300 | S | | 12/1940 | Morris | |
| 2,738,815 | A | | 3/1956 | Hoeldtke | |
| 2,798,292 | A | | 7/1957 | Bishaf | |
| 2,804,109 | A | | 8/1957 | Fatica | |
| 2,879,591 | A | | 3/1959 | Bennett | |
| 3,114,973 | A | | 12/1963 | Kennedy | |
| D203,575 | S | | 1/1966 | Dobbs | |
| 3,252,489 | A | | 5/1966 | Huston et al. | |
| 3,559,340 | A | | 2/1971 | Good | |
| 3,712,659 | A | | 1/1973 | Kneissl | |
| 3,735,434 | A | | 5/1973 | Penberthy | |
| 4,023,606 | A | | 5/1977 | Kneissl | |
| 4,308,628 | A | | 1/1982 | Kunberger et al. | |
| D266,903 | S | * | 11/1982 | Tarran | D8/76 |
| 4,850,079 | A | * | 7/1989 | Thompson | 16/421 |
| 5,210,925 | A | | 5/1993 | Morgulis | |
| 5,347,718 | A | | 9/1994 | Turner | |
| 5,425,176 | A | | 6/1995 | Brainerd et al. | |
| 5,937,466 | A | | 8/1999 | Brainerd et al. | |
| 5,996,235 | A | | 12/1999 | Brainerd | |
| 5,997,412 | A | * | 12/1999 | Benson | 473/296 |
| 6,073,307 | A | | 6/2000 | Santos et al. | |
| 6,944,955 | B2 | | 9/2005 | Skrivan et al. | |
| 7,225,544 | B2 | * | 6/2007 | Petzl | 30/381 |
| 2005/0108881 | A1 | | 5/2005 | Petzl | |

FOREIGN PATENT DOCUMENTS

| | | |
|---|---|---|
| DE | 44 17 759 | 12/1994 |
| EP | 1 388 353 | 2/2004 |
| EP | 1 533 006 | 5/2005 |
| FR | 900664 | 7/1945 |
| FR | 2 862 544 | 5/2005 |
| GB | 5494 | 3/1907 |
| GB | 9987 | 11/1911 |

* cited by examiner

COMPETITION/LEASHLESS ICE AXE WITH ADJUSTABLE GRIP

This is a continuation-in-part of U.S. patent application Ser. No. 11/231,534, filed Sep. 20, 2005, now abandoned, which is a continuation of U.S. patent application Ser. No. 10/635,102, filed Aug. 6, 2003, now U.S. Pat. No. 6,944,955, which claims the benefit of U.S. Provisional Patent Application No. 60/401,987, filed Aug. 7, 2002, all of which are herein incorporated by reference.

BACKGROUND OF THE INVENTION

1. Field of the Invention

The present invention relates generally to a competition and/or leashless type ice axe for ice climbing, Alpining, and the like. More particularly, the present invention relates to an adjustable grip for such an ice axe.

2. Related Art

Ice and mountain climbing entail the extensive use of ice axes for ascending and descending ice, snow and rock, for positioning and driving anchor screws, bolts and pins, and for clearing obstacles. In ice climbing, the strength and safety of given placement depends largely upon getting the tip of the pick portion of the ice axe securely driven into the ice. Bulges in the ice or rock, or other obstacles, can inhibit driving the pick tip securely into the ice.

Attempts to enable driving the pick of an ice axe farther into ice or rock than would normally be possible, have resulted in equipment designers putting an exaggerated bend in the ice axe handle near the pick. That is, some ice axe handles have an exaggerated bend in the direction away from that of the pick, ostensibly to accommodate bulges or other obstacles which might otherwise interfere with the handle and prevent the pick from being driven in sufficiently far.

Ice axes typically have a hammer head opposite the pick on the axe's working end. This hammer is designed primarily for driving bolts or pins. On conventional ice axes, the hammer portion of the axe head is shorter than the pick relative to the center of the axe handle, and typically has a bottom surface that is flat.

In addition, competition or leashless type ice axes include a double grip or handle with a primary or off-set handle disposed adjacent and below a secondary or shaft handle. The primary handle is off-set and oriented at an angle inwardly with respect to the secondary handle. The user or climber uses the primary handle while climbing until or unless it is necessary to grip the secondary handle with the second hand. One disadvantage with such ice axes is that the primary handles often are only one size, and fail to properly position the user's hand with respect to the handles. During use, the climber swings the axe back and forth, with a transition point between the primary and secondary handles pivoting in the climber's hand. One complaint is that the primary handle positions the climber's hand too low on the primary handle, resisting the pivot action of the axe during use.

SUMMARY OF THE INVENTION

It has been recognized that it would be advantageous to develop an improved ice axe that is safe and easy to use. In addition, it has been recognized that it would be advantageous to develop an ice axe that pivots correctly in the climber's hand, despite the size of the user's hand.

The invention provides an ice axe device with an adjustable grip or handle to properly fit the size of the user's hand. The ice axe device includes an elongated shaft with opposite proximal and distal ends. A pick is disposed at the distal end of the elongated shaft, and a grip is disposed at the proximal end of the elongated shaft. A pommel is adjustably securable in a lateral fashion to the grip, and is movable towards and away from the grip to respectively narrow and widen the space between the pommel and the grip.

The invention also provides an ice axe device with an adjustable grip or handle to properly fit the size of the user's hand. The ice axe device includes an elongated shaft with opposite proximal and distal ends. A pick is disposed at the distal end of the elongated shaft, and a grip is disposed at the proximal end of the elongated shaft. A pommel is adjustably securable to the grip, and is movable towards and away from the grip to respectively shorten and lengthen a length of the grip. A spike is disposed on the pommel.

The invention further provides an ice axe device with an adjustable grip or handle to properly fit the size of the user's hand. The ice axe device includes an elongated shaft with opposite proximal and distal ends. A pick is disposed at the distal end of the elongated shaft, and a grip is disposed at the proximal end of the elongated shaft. A pommel is adjustably securable to the grip, and is movable in a pivotal fashion down and away and up and towards the grip to respectively lengthen and widen and shorten narrow the grip. A spike is disposed on the pommel.

In accordance with a more detailed aspect of the present invention, the device can include at least one spacer selectively disposable on the grip to selectively shorten and lengthen the length, or widen and narrow the grip.

In accordance with another more detailed aspect of the present invention, the device can include a carabiner hole formed in the spike.

Additional features and advantages of the invention will be apparent from the detailed description which follows, taken in conjunction with the accompanying drawings, which together illustrate, by way of example, features of the invention.

DETAILED DESCRIPTION

Figure 1:
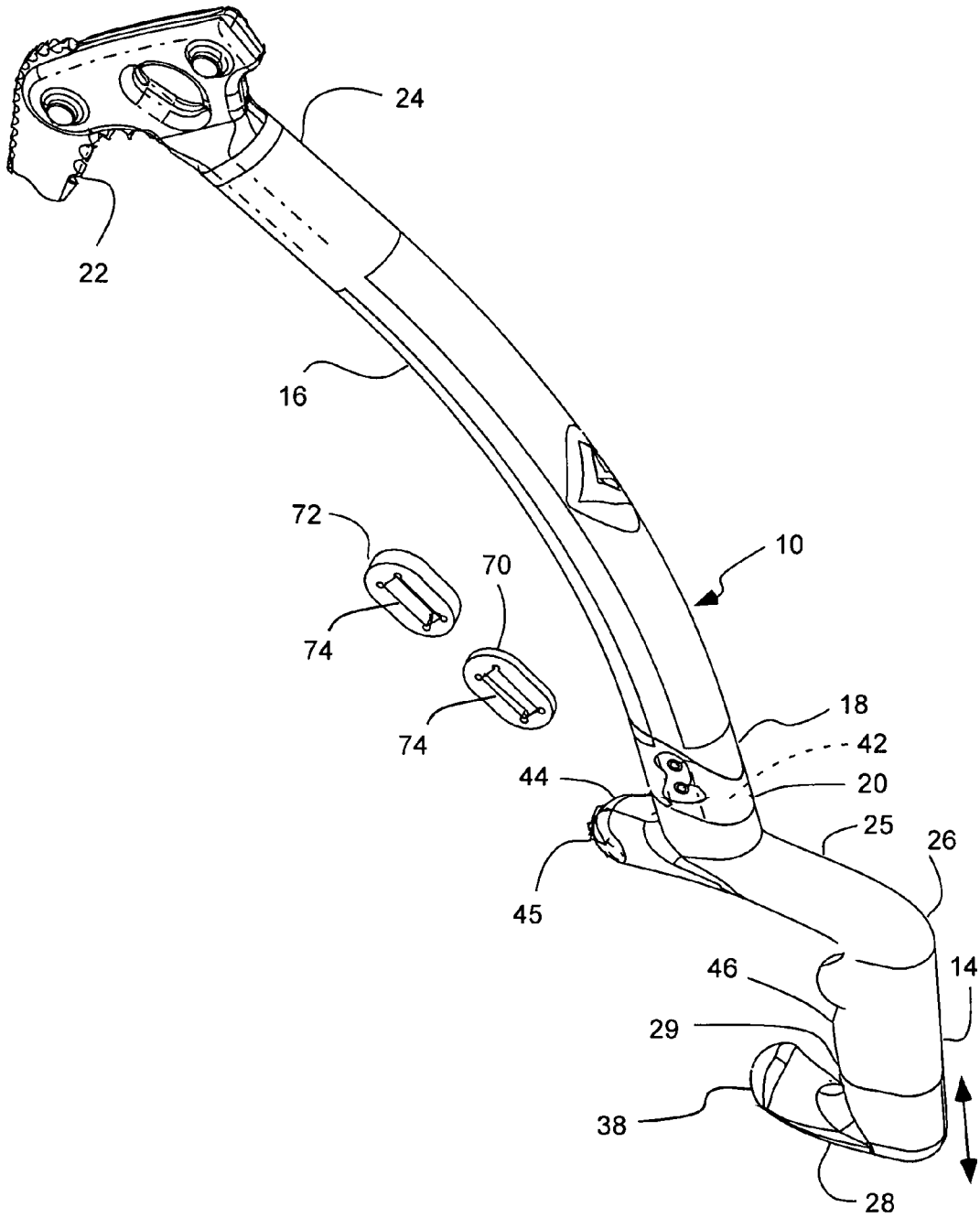
FIG. 1 is a perspective view of a competition or leashless ice axe with an adjustable handle or grip in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides an adjustable handle or grip for an ice axe to accommodate the size of a climber's hand. The grip can include a pommel that adjusts laterally to widen or narrow a space between the grip and the pommel; a pommel that adjusts longitudinally to lengthen or shorten a length of the grip; or a pommel that pivots towards and away from the grip to widen or narrow a space between the grip and the pommel, and that lengthens or shortens the grip. In addition, the present invention also provides a spike on the pommel to facilitate climbing. Ice climbing, Alpining, and the like are examples of fields that can benefit from the use of such an ice axe. The ice axe device 10 can be a competition or leashless type ice axe.

As illustrated in FIG. 1, an ice axe device, indicated generally at 10, with an adjustable handle or grip 14 in accordance with the present invention is shown for accommodating the size of a climber's hand during ice climbing and the like.

The ice axe device 10 can include an elongated shaft 16 with a secondary handle or grip 18 disposed on a proximal end 20, and an axe head with a pick 22 or the like disposed on a distal end 24. The axe head or pick 22 can have various different configurations, as understood by those skilled in the art. The adjustable grip 14 can be a primary or offset grip, and can be disposed on the proximal end 20 of the shaft 16, below the secondary grip 18, or on a proximal end of the secondary grip 18. The shaft can be straight or angled, as known in the art.

The user or climber can grip the primary or offset grip 14 to swing the pick 22 of the ice axe 10 into the ice, etc. The primary grip 14 can be spaced behind and below the secondary grip 18. In addition, the offset grip 14 can have a different angular orientation with respect to the secondary grip 18, and can form an acute angle therewith. Thus, the primary and secondary grips 14 and 18 are off-set from one another. An attachment arm 25 can connect the primary grip 14 to the ice axe 10 or secondary grip 18. The attachment arm 25 can extend rearwardly from the proximal end of the ice axe or secondary grip to a distal end of the primary grip 14.

In use, the climber holds the ice axe 10 with the primary or off-set grip 14, and swings the axe into the ice. In competition climbing, the climber rapidly swings the ice axe back and forth, with the ice axe pivoting back and forth in the climber's hand. During the swing or pivot of the ice axe, it is desirable for a transition portion 26 of the primary grip 14 to pivot in the climber's hand for maximum force and comfort. The transition portion 26 can be formed between the arm 25 and the primary grip 14, and can be arcuate or angled. The transition portion 26 can form a bend that fits into the palm of the climber's hand.

As described above, to properly use the ice axe 10, the primary or off-set grip 14 should be positioned so that the transition portion 26 can pivot in the user's hand. One complaint with typical ice axes is the difficulty in properly positioning the grip. For example, typical grips are often provided in a single size. Thus, many climbers have difficulty obtaining the proper grip or position. For example, a climber with smaller hands can have their hand slip downward to the bottom of the grip, so that there is a gap between the top of their hand, and the attachment arm, and so that the transition portion is positioned above their hand, rather than at or in their hand.

Figure 4:
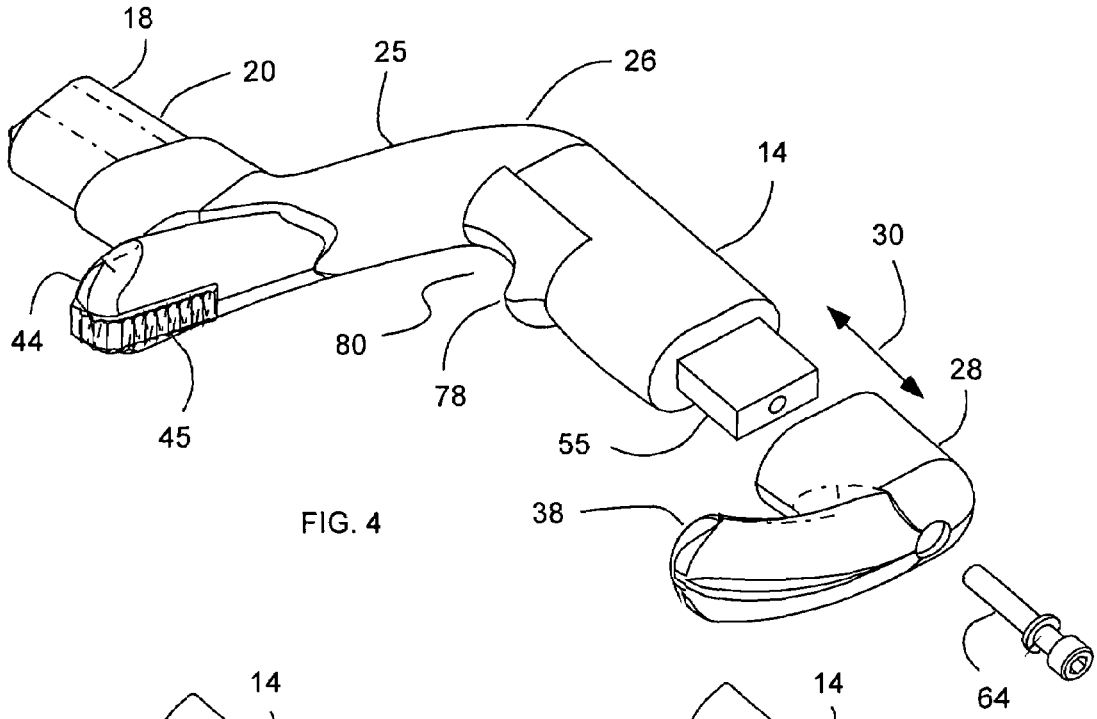
FIG. 4 is a partial exploded view of the adjustable grip of FIG. 1.

The primary or off-set grip 14 the ice axe 10 advantageously is adjustable, or is an adjustable grip. The adjustable grip 14 can include a pommel or tip 28 that can be adjustably securable to a proximal end 29 of the primary grip 14. The pommel 28 can be movable towards and away from the primary grip, indicated by arrow 30 (FIG. 4), to respectively shorten and lengthen a length of the primary grip 14. The pommel 28 can be selectively positioned along the length of the primary grip 14, indicated by arrow 30 (FIG. 4). Thus, the length of the primary grip 14 can be adjusted to suit the size of the climber's hand. The pommel or tip 28 can be positioned so that the primary grip has a length substantially the width of the climber's hand. Thus, the lower surface of the climber's hand can be positioned against the pommel or pommel 28, while the upper surface of the climber's hand can be positioned against the attachment arm 25. As the climber hangs from the ice axe 10, the pommel or tip 28 keeps the climber's hand against a top of the primary grip 14. Thus, the climber can swing the axe with the transition portion 26 properly positioned for maximum swing and comfort.

The pommel 28 can form a knob, tip or end that is larger or wider than the grip, or that extends laterally beyond a cross-sectional or lateral perimeter of the grip, to retain the climber's hand on the grip. The pommel 28 can include a protrusion 38 that extends transverse or lateral to a longitude of the grip. The protrusion 38 can have a concave indentation formed therein to receive the lower portion or outer finger of the climber's hand. In addition, the protrusion 38 can be flared, or can widen as it extends outwardly from the grip.

Figure 5:
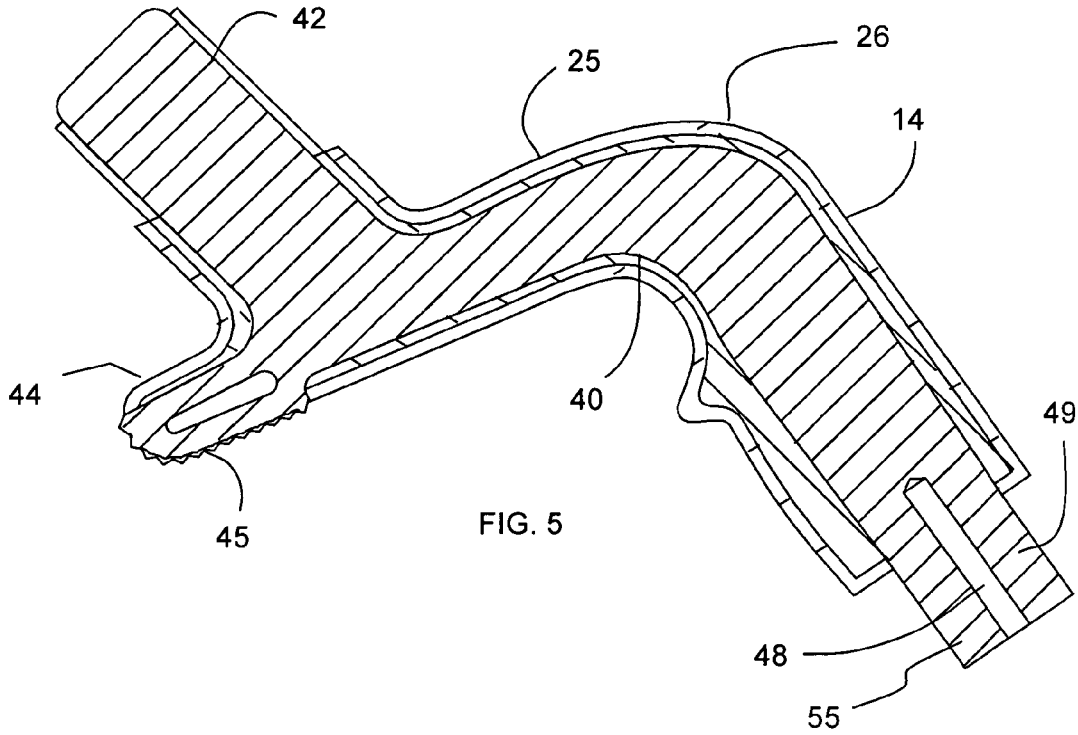
FIG. 5 is a cross-sectional side view of the adjustable grip of FIG. 1.
Figure 8:
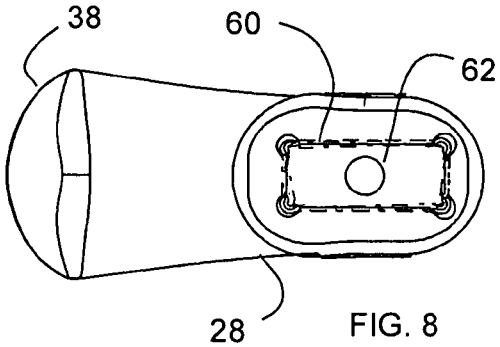
FIG. 8 is a top view of the pommel of FIG. 6.
Figure 6:
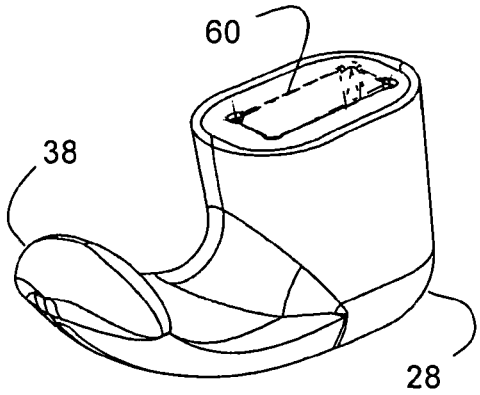
FIG. 6 is a perspective view of a pommel of the adjustable grip of FIG. 1.
Figure 10:
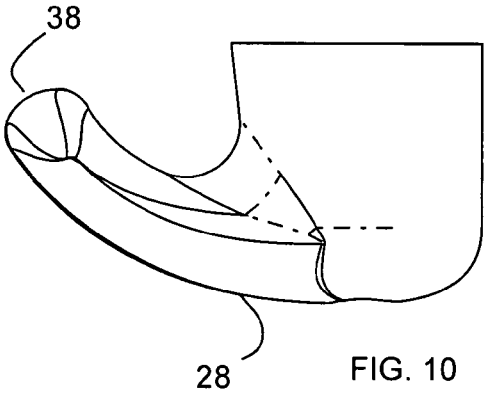
FIG. 10 is a side view of the pommel of FIG. 6.
Figure 7:
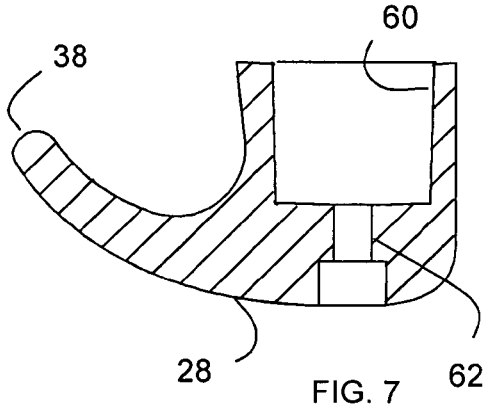
FIG. 7 is a cross-sectional side view of the pommel of FIG. 6.
Figure 9:
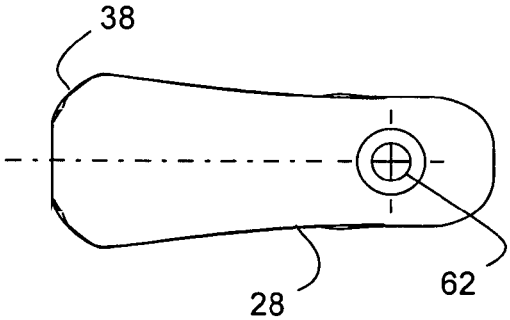
FIG. 9 is a bottom view of the pommel of FIG. 6.
Figure 11:
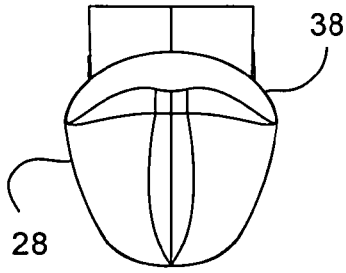
FIG. 11 is an end view of the pommel of FIG. 6.

Referring to FIG. 5, the primary grip 14 can include an internal support or frame 40. The frame 40 can be formed of a strong material, such as metal, to support the climber's weight hanging from the ice axe, and the impact of the ice axe being driven into the ice. The frame 40 can be formed from sheet material cut or stamped to the desired shape and size. The frame 40 can include an insert section 42 that can be inserted into an end of the shaft 16. In addition, the frame 40 can include a projection 44 adjacent the insert section 42 to form a secondary pommel 45 for the secondary grip 18 (FIG. 1). The frame 40 can be shaped to form the attachment arm 25, the transition portion 26, and the primary grip 14. The frame 40 can be wholly or partially surrounded by grip portions 46 (FIG. 1), particularly on the sides of the frame 40, to provide a wider and more comfortable grip. The grip portions 46 can be made of a firm and/or high friction material. A bore 48 can be formed at a proximal end 49 of the frame to receive a fastener. For example, the bore 48 can be threaded to receive a bolt, as described below.

The secondary pommel 45 can extend laterally outwardly from the secondary grip 18. The secondary pommel 45 can extend forwardly, in the direction of the axe head, and can have a serrated edge facing forwardly and/or downwardly to act as a secondary engagement or gripping surface along with the axe head.

Referring to FIGS. 4 and 6-11, the proximal end 49 of the frame 40 or of the grip 14 forms a grip shaft or a protrusion 55 of the grip. The pommel or tip 28 can include a cavity 60 to receive the protrusion 55 of the grip 14. The protrusion 55 and the cavity 60 can have matching, non-circular cross-sectional shapes to maintain the pommel 28 aligned with the grip 14. A bore 62 can be formed in a bottom of the pommel or pommel 28 to receive a fastener 64 (FIG. 4), such as a screw or bolt, to secure the pommel or tip 28 to the protrusion 55, and thus to the frame 40 and grip 14. The fastener 64 can extend through the pommel 28 and into the threaded bore 48 of the protrusion 55. The bolt can be counter-sunk in the pommel. The screw or bolt is one example of means for securing the protrusion 55 of the grip 14 in the cavity 60 of the pommel 28. Other means can be used, including for example, set screws, etc.

Figure 2:
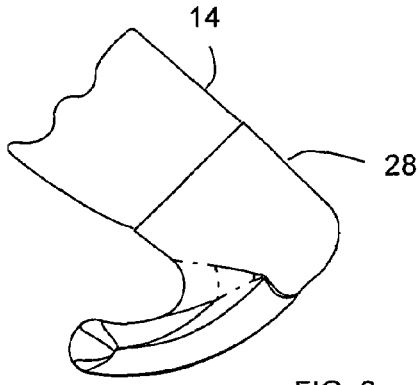
FIG. 2 is a partial side view of the adjustable grip of FIG. 1 shown in a shorter configuration.

Referring to FIGS. 1-4, one or more spacers 70 and 72 can be selectively disposable on the primary grip 14 to selectively shorten and lengthen the length of the primary grip. The spacers 70 and 72 can be disposed on the protrusion 55 of the grip, between the pommel 28 and the frame 40 or grip 14. The spacers 70 and 72 can have an aperture or bore 74 that extends through the spacer and receives the protrusion 55 of the grip. It will be appreciated that adding spacers 70 and 72 to the grip 14 lengthens the grip (as shown in FIGS. 3*a-c*), while removing spacers 70 and 72 shortens or narrows the grip 14 (as shown in FIG. 2). Thus, a climber can add or remove spacers 70 and 72 to lengthen or shorten the grip 14 to accommodate the size of their hand, and properly position their hand. For example, the grip can have a length sized for a smaller hand, and provided with spacers so that climbers with larger hands can lengthen the grip. In addition, the spacers 70 and 72 can fill any gap between the pommel 28 and grip 14, providing a smooth continuous grip surface. Thus, the spacers can have an outer size that matches an outer size of the grip, and can have an outer surface that is flush with an outer surface of the grip.

Figure 3A:
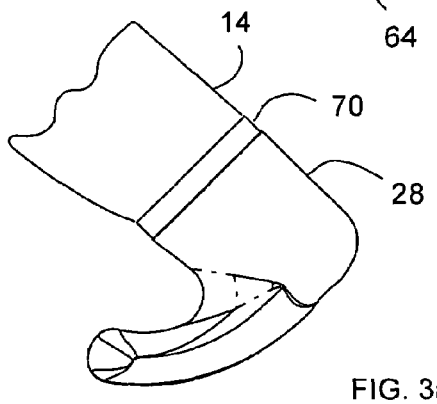
FIGS. 3*a-c* are partial side views of the adjustable grip of FIG. 1 shown in longer configurations.
Figure 3B:
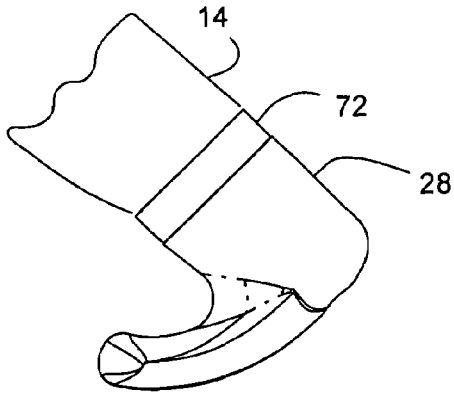
Figure 3C:
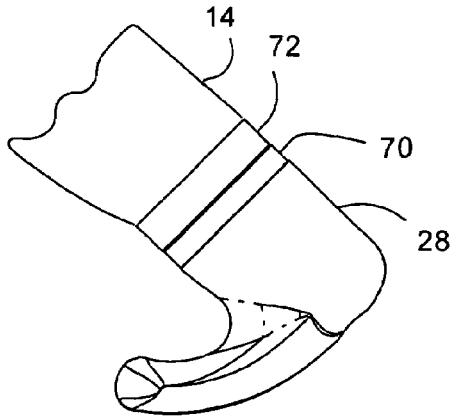

The ice axe 10 can be provided with a set of spacers, or a plurality of spacers of different sizes or widths. Thus, a particular spacer with a particular width can be inserted in the grip to achieve the desired size. For example, one spacer 70 can have a width of ¼ inch, and another spacer 72 can have a width of ⅛ inch. Thus, the length of the grip can be adjusted up to ⅜ inches (with both spacers) in ⅛ inch increments (⅛ inch, ¼ inch, and ⅜ inch with both the ⅛ inch and ¼ inch spacer). For example, the grip can be lengthened ⅛ inch with the ⅛ inch spacer 70 (FIG. 3*a*); lengthened ¼ inch with the ¼ inch spacer 72 (FIG. 3*b*); or lengthened ⅜ inches with both spacers 70 and 72 (FIG. 3*c*).

In use, the pommel 28 is adjustably securable to a proximal end of the grip 14, and moved towards or away from the primary grip 14 to respectively shorten or lengthen a length of the grip. The pommel 28 can be removed from the grip 14 by removing the fastener 64. Spacers 70 and/or 72 can be added or removed to lengthen or shorten the length of the grip. The pommel can be re-secured to the grip with the fastener.

Referring to FIG. 4, the primary grip 14 can include a protrusion 78 at an upper end and extending forwardly to form a space 80 at the top of the grip to receive the climber's index finger. Thus, the climber's index finger can form a pivot point for swinging the ice axe. The protrusion 78 and space 80 form a partial pivot surface around the climber's index finger. In addition, the protrusion 78 forms additional gripping to resist the climber's hand from sliding down the grip.

Figure 12:
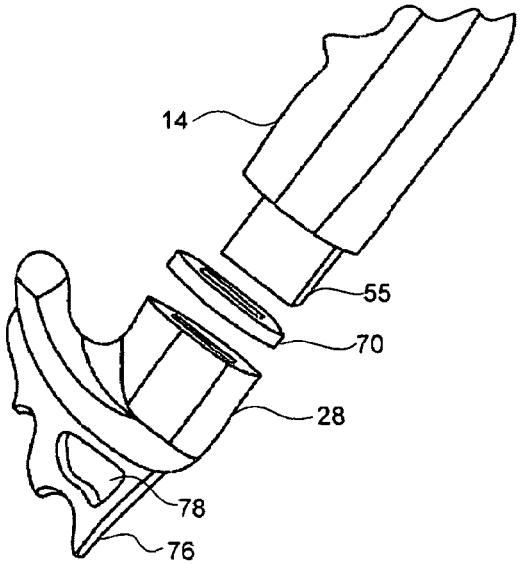
FIG. 12 is a partially exploded view of an adjustable handle or grip in accordance with an embodiment of the present invention.

Referring to FIG. 12, the pommel 28 can include a spike or ferrule 76. A spike can assist a climber when hiking through an icy region, where the hiker can hold the ice axe by the head or pick and thrust the spike into the ground for stability while traveling. Additionally, this spike can be used when a climber is ascending a rock or ice precipice, for picking the ice by hitting butt of the handle, having the spike, into the ice. The spike can have a variety of shapes and sizes, including: a single spike; multiple spikes; or a serrated edge, facing in any direction. Further, the spike can include a carabiner hole 78 for clipping a carabiner and hanging a weight on the pick that has been driven into the ice, a hole in a rock, or the like.

Figure 13:
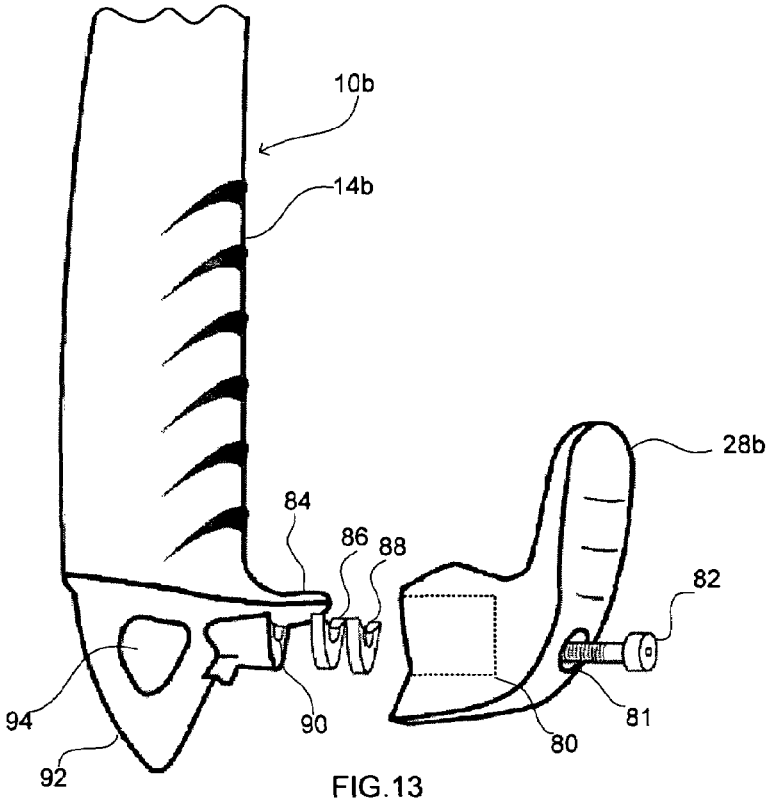
FIG. 13 is a partially exploded view of another adjustable handle or grip in accordance with an embodiment of the present invention.

Referring to FIG. 13, an ice axe 10*b* can have a laterally adjustable pommel 28*b* that can be configured to be adjustably securable to the proximal end of a grip 14*b*. The ice axe 10*b* can be similar to that described above, and the grip 14*b* can be a primary or off-set grip similar to that described above. Alternatively, the grip 14*b* can be a single grip. The pommel 28*b* can be laterally adjustable with respect to the grip 14*b* or primary grip in a lateral fashion. This feature can provide for increased sizing capability for climbers with various hand and finger sizes and for a plurality of glove thicknesses by varying the space available for the hand and/or finger(s). The pommel can be laterally movable towards and away from the grip to respectively narrow and widen the space between the pommel and the grip. The pommel can be laterally configured to be fastened to the grip or primary grip in a similar manner to the longitudinal configuration shown in FIGS. 1-11, as previously described. The grip or primary grip can include a lateral protrusion 84 and a bore 90. Additionally, the pommel can include a cavity 80 to receive the protrusion 84 therein, and a bore 81 configured to receive a fastener 82. The pommel can further be provided with a set of spacers 86 and 88, or a plurality of spacers of different sizes or widths. The spacers 86 and 88 can be disposed on the protrusion 84, and can be received within the cavity 80 of the pommel. Thus, one or more particular spacers with a particular width can be inserted in the assembly to achieve the desired size. Additionally, a spike or ferrule 92 can be included either on the grip or primary grip, or on the pommel. This spike can be of a variety of shapes or sizes, as previously described. Further the spike can include a carabiner hole 94, configured to receive a carabiner.

Figure 14:
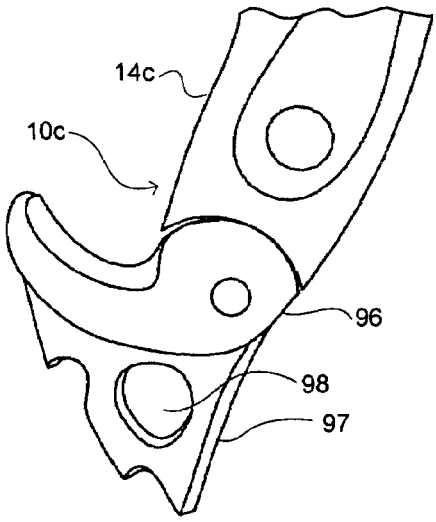
FIG. 14 is a partial side view of another adjustable handle or grip in accordance with an embodiment of the present invention.

Referring to FIG. 14, an ice axe 10*c* can be provided with a pivotal pommel 96 configured to have both longitudinal and lateral sizing capabilities with respect to a grip 14*c*, and can be provided with a spike or ferrule 97. As such, the pommel can be configured to be adjustable both laterally and longitudinally. Accordingly, the pommel can be adjustably sizable for a larger variety of hand and glove sizes, to accommodate for both longer/shorter and wider/narrower hands and gloves. The pivoting pommel 96 can simultaneously modify both the length and space between the pommel and the grip. The pivoting pommel can have a variety of configurations, shapes, and locking means, such as that described in U.S. Patent Application Publication No. 2005/0108881, which is herein incorporated by reference. The spike can further include a carabiner hole 98 for receiving a carabiner, as previously described.

Figure 15:
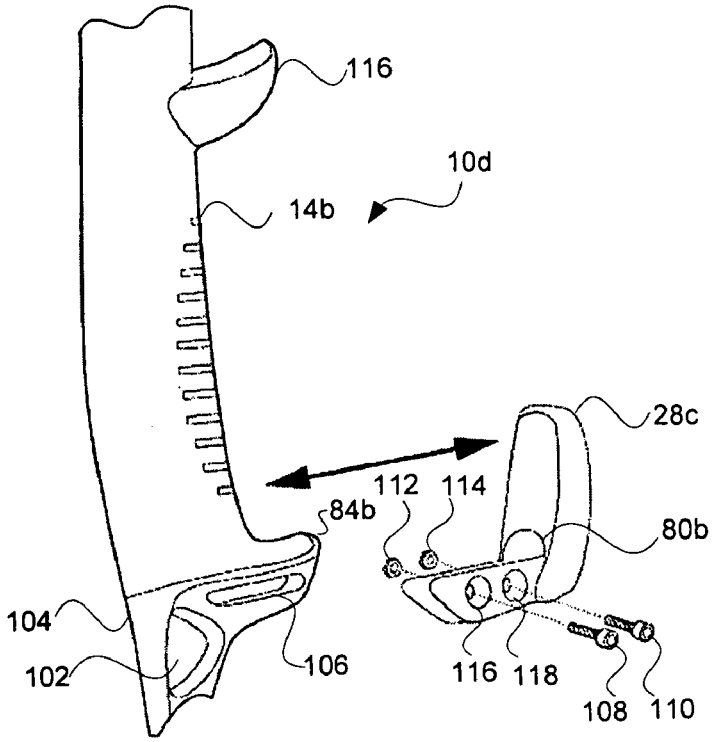
FIG. 15 is a partial side view of another adjustable handle or grip in accordance with an embodiment of the present invention.

Referring to FIG. 15, an ice axe 10*d* can have a laterally adjustable pommel 28*c* that can be configured to be adjustably securable to the proximal end of a grip 14*b*, so as to provide increased sizing capabilities similar to those provided by the embodiment represented in FIG. 13. The grip can include an upper protrusion 116 for stabilizing a user's hand in position on the grip. The grip or primary grip can also include a lateral protrusion 84*b* and a lateral slot 106. The pommel can include a cavity 80*b* to receive the protrusion 84*b* therein, and a plurality of bores 116 and 118 configured to receive fasteners 108 and 110 therein. The pommel can also include a set of nuts 112 and 114 corresponding to the fasteners. The nuts can be received into nut-shaped bores (not shown) in the pommel to aid in loosening and tightening the fasteners. The respective shapes of the lateral protrusion and the pommel cavity can be configured to allow the lateral protrusion to securably mate with the cavity of the pommel without allowing for excessive freedom of movement. Further, the plurality of pommel bores 116 and 118 can be configured to be aligned with the lateral slot when the pommel is securably mated with the lateral protrusion. By inserting the fasteners through the bores, lateral slot, and nuts when the pommel is mated with the lateral protrusion, a user can slidably adjust the pommel to the grip according to their liking, and then tighten the fasteners in place. This feature allows a user to quickly adjust the sizing of the grip by simply loosening the fasteners, sliding the pommel to the desired position, and re-tightening the fasteners. A spike or ferrule 104 can be included either on the grip or primary grip, or on the pommel. The spike can include a carabiner hole 102, configured to receive a carabiner.

Figure 16:
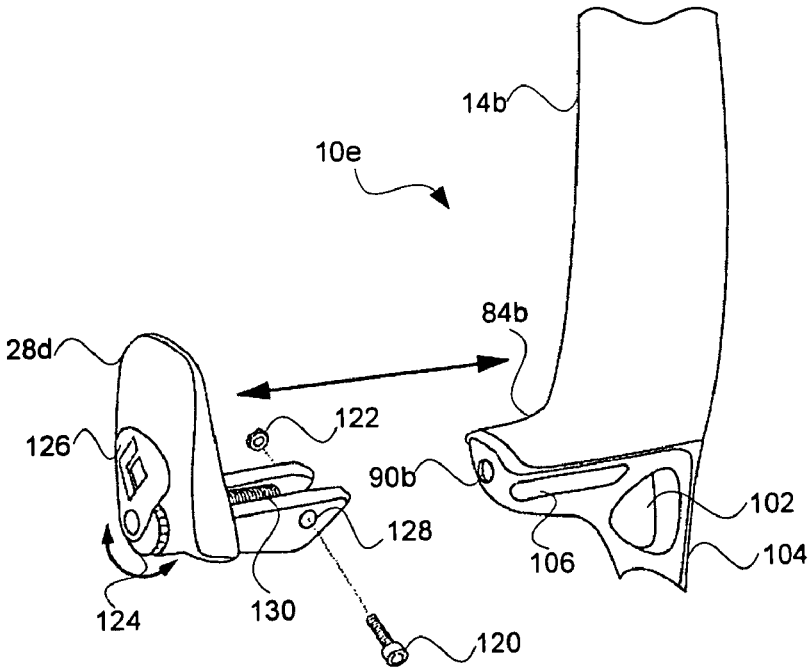
FIG. 16 is a partial side view of another adjustable handle or grip in accordance with an embodiment of the present invention.

Referring to FIG. 16, an ice axe 10*e* can have a laterally adjustable pommel 28*d* similar to that of the embodiment represented in FIG. 15. The grip or primary grip and pommel shape can also be similar to those of FIG. 15 however the grip can further include a bore 90*b*. The pommel can include a cavity (not shown) for receiving the lateral protrusion 84*b* therein, and a bore 128 configured to receive a fastener 120 therein. The pommel can also include a nut 122 corresponding to the fastener 120. The nut can be received into a nut-shaped bore (not shown) in the pommel to aid in loosening and tightening the fastener. The pommel bore 128 can be configured to be aligned with the lateral slot 106 when the pommel is securably mated with the lateral protrusion. By inserting the fastener through the bore, lateral slot, and nut when the pommel is mated with the lateral protrusion, allows the pommel to stably slide along the lateral protrusion. The pommel can further include a fitter screw 130 having a fitter screw head 124 and a lever arm 126. The fitter screw can be inserted through a bore (not shown) of the pommel. The fitter screw can then be inserted into the bore 90*b* of the grip. A user can then manually turn the lever arm 126 of the fitter screw to screw it to a desired depth within the bore 90*b* of the grip to adjust the width of the grip-pommel spacing to the desired size. This feature allows a user to quickly adjust the grip-pommel spacing by simply turning the fitter screw, with the hand alone. A spike or ferrule 104 can also be included either on the grip or primary grip, or on the pommel. Further the spike can include a carabiner hole 102, configured to receive a carabiner.

Various other aspects of the ice axe device are described in U.S. Pat. Nos. 5,425,176; 5,768,727; 5,937,466; and 5,996,235, which are herein incorporated by reference.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

The invention claimed is:

1. An ice axe device, comprising:

a) an elongated shaft with opposite proximal and distal ends;

b) a pick, disposed at the distal end of the elongated shaft;

c) a grip, disposed at the proximal end of the elongated shaft;

d) a pommel, adjustably securable to the proximal end of the grip, movable towards and away from the grip;

e) a spike, disposed on the pommel and adjustable with the pommel;

f) at least one spacer, selectively disposable on the grip, to selectively lengthen a length of the grip;

g)a protrusion, formed on the proximal end of the grip, and extendable into a cavity of the pommel; and h)a bore, extending through the at least one spacer to receive the protrusion of the grip therethrough.

2. A device in accordance with claim 1, further comprising: a carabiner hole, formed in the spike.

3. A device in accordance with claim 1, wherein the grip is a primary grip disposed at a proximal end of a secondary grip disposed at the proximal end of the shaft; and wherein the primary grip is offset from the secondary grip.

4. A device in accordance with claim 1, wherein the at least one spacer is selectively disposed between the grip and the pommel.

5. A device in accordance with claim 1, further comprising: means for securing the protrusion in the cavity.

6. A device in accordance with claim 1, wherein the pommel is removably disposable on the proximal end of the grip, and further comprising another different pommel, without a spike, removably disposable on the proximal end of the grip.

7. An ice axe device, comprising:

a) an elongated shaft with opposite proximal and distal ends;

b) a pick, disposed at the distal end of the elongated shaft;

c) a grip, disposed at the proximal end of the elongated shaft; and d) a pommel, adjustably securable to the proximal end of the grip, movable towards and away from the grip;

e) a spike, associated with the grip;

f) a protrusion, formed on the proximal end of the grip, and extendable into a cavity of the pommel; and g) a bore, extending through at least one spacer to receive the protrusion of the grip therethrough.

8. A device in accordance with claim 7, further comprising: a carabiner hole, formed in the spike.

9. A device in accordance with claim 7, wherein the grip is a primary grip disposed at a proximal end of a secondary grip disposed at the proximal end of the shaft; and wherein the primary grip is offset from the secondary grip.

10. A device in accordance with claim 7, wherein the at least one spacer, selectively disposable on the grip, to selectively lengthen a length of the grip.

11. A device in accordance with claim 7, wherein the pommel is removably disposable on the proximal end of the grip, and further comprising another different pommel, without a spike, removably disposable on the proximal end of the grip.

12. device in accordance with claim 7, wherein the spike is adjustable with the pommel.

13. An ice axe device, comprising:

a) an elongated shaft with opposite proximal and distal ends;

b) a pick, disposed at the distal end of the elongated shaft;

c) a grip, disposed at the proximal end of the elongated shaft;

d) a pommel, longitudinally adjustably securable to the proximal end of the grip, movable towards and away from the grip;

e) a spike, disposable on the grip and longitudinally adjustable with the pommel with respect to the grip;

f) at least one spacer, selectively disposable on the grip, to selectively lengthen a length of the grip;

g) a protrusion, formed on the proximal end of the grip, and extendable into a cavity of the pommel; and h) a bore, extending through the at least one spacer to receive the protrusion of the grip therethrough.

14. A device in accordance with claim 13, further comprising:

a carabiner hole, formed in the spike.

15. A device in accordance with claim 13, wherein the grip is a primary grip disposed at a proximal end of a secondary grip disposed at the proximal end of the shaft; and wherein the primary grip is offset from the secondary grip.

16. A device in accordance with claim 13, wherein the pommel is removably disposable on the proximal end of the grip, and further comprising another different pommel, without a spike, removably disposable on the proximal end of the grip.

* * * * *